US009133589B2

(12) United States Patent
Ball

(10) Patent No.: US 9,133,589 B2
(45) Date of Patent: Sep. 15, 2015

(54) BOLLARDS

(75) Inventor: Robert N Ball, Cheshire (GB)

(73) Assignee: ATG ACCESS LTD. (GB)

( * ) Notice: Subject to any disclaimer, the term of this patent is extended or adjusted under 35 U.S.C. 154(b) by 0 days.

(21) Appl. No.: 14/122,798

(22) PCT Filed: May 25, 2012

(86) PCT No.: PCT/GB2012/051198

§ 371 (c)(1),
(2), (4) Date: Feb. 18, 2014

(87) PCT Pub. No.: WO2012/164275

PCT Pub. Date: Dec. 6, 2012

(65) Prior Publication Data

US 2014/0161521 A1 Jun. 12, 2014

(30) Foreign Application Priority Data

May 27, 2011 (GB) ..... 1109010.7

(51) Int. Cl.
*E01F 13/00* (2006.01)
*E01F 13/04* (2006.01)
*E01F 13/12* (2006.01)

(52) U.S. Cl.
CPC ..... *E01F 13/046* (2013.01); *E01F 13/12* (2013.01)

(58) Field of Classification Search
CPC ..... E01F 9/019; E01F 13/046; E01F 13/12
USPC ..... 404/11, 6, 9
See application file for complete search history.

(56) References Cited

U.S. PATENT DOCUMENTS

| | | | |
|---|---|---|---|
| 1,574,908 | A | 3/1926 | Lamp |
| 1,848,516 | A | 3/1932 | Davison |
| 2,006,233 | A | 6/1935 | Chretien |
| 2,263,649 | A | 11/1941 | Sawyer |
| 3,810,595 | A | 5/1974 | Doolittle |

(Continued)

FOREIGN PATENT DOCUMENTS

| | | |
|---|---|---|
| CH | 700218 | 7/2010 |
| DE | 2309249 | 8/1974 |

(Continued)

OTHER PUBLICATIONS

GB Combined Search and Examination Report corresponding to GB1214276.6 dated Mar. 19, 2013.

(Continued)

*Primary Examiner* — Raymond W Addie
(74) *Attorney, Agent, or Firm* — Niels Haun; Dann Dorfman Herrell & Skillman

(57) ABSTRACT

A bollard apparatus comprising an outer bollard member (3) comprising a bore, an inner bollard member (5) at least a part of which is located within said bore and is moveable along the bore from a retracted state in which at least some of the inner bollard member is located within the bore to an extended state in which less of the inner bollard member is located within the bore. At least one urging member (19) is arranged to exert an urging force upon the inner bollard member to urge the inner bollard member towards the extended state. A lifting apparatus (12) is coupled to the inner bollard member and operable to exert a lifting force thereupon sufficient to lift the inner bollard to the extended state when also subject to the urging force.

19 Claims, 14 Drawing Sheets

(56) References Cited

U.S. PATENT DOCUMENTS

| | | | | |
|---|---|---|---|---|
| 3,861,097 | A | 1/1975 | Patterson | |
| 4,240,766 | A | 12/1980 | Smith | |
| 4,576,508 | A | 3/1986 | Dickinson | |
| 4,844,653 | A | 7/1989 | Dickinson | |
| 4,919,563 | A | 4/1990 | Stice | |
| 4,973,189 | A | 11/1990 | Bechtold | |
| 5,474,017 | A | 12/1995 | Mohebbi | |
| 5,481,828 | A | 1/1996 | Kentrotas | |
| 5,547,310 | A | 8/1996 | Muller | |
| 5,829,912 | A | 11/1998 | Marcotullio | |
| 5,975,792 | A * | 11/1999 | Goeken et al. | 404/6 |
| 6,174,103 | B1 | 1/2001 | Stroman | |
| 6,435,760 | B1 | 8/2002 | Pettesch | |
| 6,626,606 | B1 | 9/2003 | Johnson | |
| 7,244,075 | B2 | 7/2007 | Stadler | |
| 7,607,856 | B2 | 10/2009 | Patel | |
| 7,850,391 | B2 | 12/2010 | Omar | |
| 8,096,727 | B2 | 1/2012 | Parenti | |
| 8,197,156 | B2 | 6/2012 | Morgan | |
| 8,215,865 | B2 | 7/2012 | Adler | |
| 8,277,143 | B2 | 10/2012 | Adler | |
| 8,523,479 | B2 | 9/2013 | Adler | |
| 2003/0051406 | A1 | 3/2003 | Ritz | |
| 2003/0145498 | A1 | 8/2003 | Venegas | |
| 2004/0091315 | A1 | 5/2004 | Yodock | |
| 2004/0151542 | A1 | 8/2004 | Johnson | |
| 2004/0159055 | A1 | 8/2004 | Stone | |
| 2005/0031411 | A1 | 2/2005 | Hensley | |
| 2005/0073275 | A1 | 4/2005 | Robb | |
| 2005/0098770 | A1 | 5/2005 | Schell | |
| 2006/0204327 | A1 | 9/2006 | Phelan | |
| 2006/0233608 | A1 | 10/2006 | Netah et al. | |
| 2007/0031189 | A1 * | 2/2007 | Stadler | 404/6 |
| 2007/0086858 | A1 | 4/2007 | Morgan | |
| 2007/0258762 | A1 | 11/2007 | Stice | |
| 2008/0038056 | A1 | 2/2008 | Patel | |
| 2008/0038057 | A1 | 2/2008 | Stadler | |
| 2008/0112756 | A1 | 5/2008 | Omar | |
| 2008/0187396 | A1 | 8/2008 | McCue | |
| 2009/0047066 | A1 | 2/2009 | Stice | |
| 2009/0202296 | A1 | 8/2009 | Lamore | |
| 2009/0208285 | A1 | 8/2009 | Adler | |
| 2009/0250674 | A1 | 10/2009 | Darcy | |
| 2010/0166498 | A1 | 7/2010 | Adler | |
| 2010/0290832 | A1 | 11/2010 | House | |
| 2011/0033232 | A1 | 2/2011 | Adler | |
| 2012/0230764 | A1 | 9/2012 | Lafont | |
| 2012/0251236 | A1 | 10/2012 | Hild | |
| 2012/0308302 | A1 | 12/2012 | Adler | |
| 2013/0034387 | A1 | 2/2013 | Adler | |
| 2014/0003867 | A1 | 1/2014 | Ball | |
| 2014/0010591 | A1 | 1/2014 | Ball | |
| 2014/0017003 | A1 | 1/2014 | Ball | |
| 2014/0119825 | A1 | 5/2014 | Castro | |
| 2014/0147201 | A1 | 5/2014 | Ball | |
| 2014/0161521 | A1 | 6/2014 | Ball | |
| 2014/0161523 | A1 | 6/2014 | Ball | |

FOREIGN PATENT DOCUMENTS

| | | | |
|---|---|---|---|
| DE | 3605747 | | 8/1987 |
| DE | 9316170 | | 3/1994 |
| DE | 9315671 | | 6/1994 |
| DE | 19631678 | | 2/1998 |
| DE | 19812116 | | 9/1999 |
| DE | 19815426 | | 10/1999 |
| DE | 202005013439 | | 11/2005 |
| DE | 102007052321 | A1 | 5/2009 |
| EP | 0176973 | | 4/1986 |
| EP | 369860 | | 5/1990 |
| EP | 1530921 | | 5/2005 |
| EP | 1541768 | A1 | 6/2005 |
| EP | 2161377 | | 3/2010 |
| EP | 2306034 | | 4/2011 |
| FR | 002598484 | | 11/1987 |
| FR | 2598484 | | 11/1987 |
| FR | 2621625 | | 4/1989 |
| FR | 2680190 | | 7/1993 |
| FR | 2686633 | | 7/1993 |
| FR | 002688244 | | 9/1993 |
| FR | 2721629 | | 12/1995 |
| FR | 2743097 | | 7/1997 |
| FR | 2759102 | | 8/1998 |
| FR | 275992 | | 9/1999 |
| FR | 2785308 | | 5/2000 |
| FR | 2793821 | | 11/2000 |
| FR | 2814181 | | 3/2002 |
| FR | 28141181 | | 3/2002 |
| FR | 2851586 | | 8/2004 |
| FR | 2851587 | A1 | 8/2004 |
| FR | 2925080 | | 6/2009 |
| FR | 2929627 | | 10/2009 |
| FR | 2945300 | | 11/2012 |
| GB | 140262 | | 3/1920 |
| GB | 0997053 | | 6/1965 |
| GB | 1256889 | | 12/1971 |
| GB | 1426947 | | 3/1976 |
| GB | 2125084 | | 2/1984 |
| GB | 2178094 | | 2/1987 |
| GB | 2178094 | A | 2/1987 |
| GB | 2267923 | | 12/1993 |
| GB | 2285826 | | 7/1995 |
| GB | 2372065 | | 8/2002 |
| GB | 2443631 | | 5/2008 |
| GB | 2467411 | | 8/2010 |
| GB | 2485278 | | 5/2012 |
| GB | 2487582 | | 8/2012 |
| GB | 2490118 | | 10/2012 |
| GB | 2493353 | | 2/2013 |
| JP | 2007016476 | | 1/2007 |
| JP | 2009097244 | | 5/2009 |
| WO | 9709485 | | 3/1997 |
| WO | 2004048702 | | 6/2004 |
| WO | 2004099534 | | 11/2004 |
| WO | 2007001326 | | 1/2007 |
| WO | 2007008813 | | 1/2007 |
| WO | 2007018531 | | 2/2007 |
| WO | 2007191977 | | 8/2007 |
| WO | 2007103394 | | 9/2007 |
| WO | 2009112159 | | 9/2009 |
| WO | 2010132616 | | 11/2010 |
| WO | 2013017837 | | 2/2013 |

OTHER PUBLICATIONS

GB Search Report corresponding to GB1109010.7 dated Sep. 16, 2011.

International Search Report corresponding to PCT/GB2012/051198 dated Aug. 30, 2012.

GB Search Report corresponding to GB1214276.6 dated Nov. 17, 2012.

GB Examination Report corresponding to GB 1214276.6 dated Jul. 22, 2013.

GB Search Report corresponding to GB 1113203.2 dated Jan. 25, 2012.

International Search Report corresponding to Application No. PCT/GB2012/051755 dated Mar. 12, 2013.

Written Opinion of the International Searching Authority corresponding to PCT/GB2012/051755 dated Mar. 12, 2013.

Search Report corresponding to Application No. GB1101513.8 dated May 26, 2011.

GB Combined Search and Examination Report corresponding to Application No. GB1214248.5 dated Aug. 29, 2012.

GB Search Report corresponding to Application No. GB1101514.6 dated May 27, 2011.

GB Combined Search and Examination Report corresponding to GB1214278.2 dated Dec. 10, 2012.

GB Search Report corresponding to GB1104802.2 dated May 25, 2012.

GB Search Report corresponding to GB1113211.5 dated Jan. 17, 2012.

(56) References Cited

OTHER PUBLICATIONS

International Search Report corresponding to PCT/GB2012/050175 dated May 23, 2012.
Written Opinion of the International Search Authority corresponding to PCT/GB2012/050176 dated May 21, 2012.
Written Opinion of the International Search Authority corresponding to PCT/GB2012/050173 dated May 22, 2012.
Written Opinion of the International Search Authority corresponding to PCT/GB2012/050175 dated May 23, 2012.
International Search Report corresponding to PCT/GB2012/050176 dated May 21, 2012.
International Search Report corresponding to PCT/GB2012/050173 dated May 22, 2012.
Search Report with abstracts and figures Aug. 18, 2010.
Search Report with abstracts and figures Aug. 19, 2010.
Search Report with abstracts and figures Aug. 19, 2010-bis.
Search Report with abstracts and figures Aug. 20, 2010.
Search Report with abstracts and figures Oct. 2, 2010.
Search Report with abstracts and figures Mar. 23, 2015.

* cited by examiner

BOLLARDS

RELATED APPLICATIONS

This application is a 371 application of International Application No. PCT/GB2012/051198 filed May 25, 2012, which claims the benefit of priority of United Kingdom Patent Application No. 01109010.7 filed May 27, 2011. Each of the foregoing applications is hereby incorporated herein by reference.

The present invention relates to bollards and particularly, though not exclusively, to bollards suitable for use as, or in, a vehicle impact barrier.

Collapsible or retractable bollards typically comprise a bollard member housed within a casing or sleeve and moveable from a retracted state in which most or all of the bollard is located within the sleeve, to an extended state in which less of the bollard is located within the sleeve and more of it extends outwardly of an end of the sleeve. The sleeve us usually embedded within a ground surface such that, when fully retracted, the bollard is fully withdrawn into the ground.

To achieve an extended state, the bollard must be lifted upwardly from its retracted position within the sleeve. This may be done manually, whereby a user will simply grip a handle provided at (or attachable to) the top of the bollard and pull the bollard upwardly to the extended state using manual force. Alternatively, the bollard may be lifted hydraulically or pneumatically via a hydraulic or pneumatic ram, or the like, located within the sleeve and arranged to push the bollard upwards. Once extended, the bollard may be held in that position by resting it upon a support structure provided in the sleeve, for example, when manually lifted, or by continued application of a supporting force from the hydraulic or pneumatic ram when such means are used.

Manual lifting is often difficult and potentially dangerous, especially when the bollard is heavy. It is likely to be impossible if the bollard is of the robust type employed in vehicle impact barriers which may comprise heavy steel components collectively weighing of the order of a hundred kilograms. In such cases, hydraulic or pneumatic rams are typically employed as described above. However, such rams are expensive, require expert maintenance and also require connection of peripheral power supplies to power the pumps or drive mechanisms used to operate/energise the rams. The power supplies can consume a lot of power in operation. This is often prohibitive, especially when the rams are required to be of sufficient power to lift a heavy-duty bollard assembly.

The invention aims to provide means and methods which desirably may be used in helping to address these problems.

At its most general, the invention proposed is to provide a counterweight to the weight of a retractable bollard in conjunction with a lifting apparatus for lifting the bollard such that the lifting apparatus is not required to lift the full weight of the bollard. Accordingly, the lifting apparatus may be simpler, and require less power or energy to operate it.

In a first of its aspects, the invention may provide a bollard apparatus comprising: an outer bollard member comprising a bore; an inner bollard member at least a part of which is located within said bore and is moveable along the bore from a retracted state in which at least some of the inner bollard member is located within the bore to an extended state in which less of the inner bollard member is located within the bore; at least one urging member arranged to exert an urging force upon the inner bollard member to urge the inner bollard member towards the extended state; a lifting apparatus coupled to the inner bollard member and operable to exert a lifting force thereupon sufficient to lift the inner bollard to the extended state when also subject to the urging force. The inner bollard member may be arranged to provide a retractable barrier, post or the like, while the outer bollard member may be arranged to provide a casing of housing for the inner bollard member which may or may not also form a post or barrier. The outer bollard member may be arranged to be embedded (e.g. within the ground) to enable the inner bollard member to retract into the ground as desired.

In this way, assistance to the lifting of an inner bollard member, such as a bollard tube of e.g. a retractable bollard, may be provided such that less energy is required to be provided to the lifting apparatus in order to permit it to lift the inner bollard. The energy may be provided externally or internally of the bollard apparatus. The lifting apparatus may be mechanical and adapted to receive energy to operate/apply the lifting mechanics externally of the bollard apparatus. In such a case, the lifting apparatus is preferably accessible externally of the bollard apparatus in use. The bollard apparatus may include an access opening which is accessible when the inner bollard member is in any state of extension/retraction, which is positioned to permit access to the lifting apparatus to operate it from outside of the bollard. The access opening is preferably in register with the lifting apparatus. The access opening may be formed in the inner bollard member, preferably at its head end uppermost in use, which is generally visible and accessible in all extension/retraction states of the bollard. The inner bollard member may include a bore within which at least a part of the lifting apparatus is located and coupled to the inner bollard member. The bore of the inner bollard member may be accessible via the access opening to permit access to the lifting apparatus therein. Internal provision of energy for the lifting apparatus may be in the form of power for a pneumatic, hydraulic or electrical means (e.g. a ram) or any motorised mechanism for generating motive force, and may be located within the bollard apparatus. The inner bollard member may comprise a through-opening (access opening) permitting access to the lifting apparatus. The lifting apparatus may be arranged and adapted to allow a turning force to be applied to it via the through-opening. The lifting apparatus may be arranged to convert the turning force to a lifting force (when extending the bollard) or a lowering force (when retracting the bollard), in use. The lifting apparatus may comprise an interface part adapted (e.g. shaped) to couple/interface with external turning apparatus (e.g. a crank/power drill head etc) for transferring turning forces to the lifting apparatus. The access opening is preferably in register with the interface part of the lifting apparatus. The lifting apparatus may include a threaded shaft (e.g. lead screw, or the like) coupled to threaded nut connected to the outer bollard member and arranged to convert rotation of the threaded shaft into linear movement of the shaft through the threaded nut. An end of the threaded shaft, or the like, may have a cross-sectional profile adapted to be received intimately within the head socket of the type used with a socket wrench or the like. Such a head socket may be powered manually via a mechanical wrench or electrically via a hand-held electrical drill or the like. In either case rotational power may be generated externally from the bollard assembly. For example, by coupling the head end of the threaded shaft to an electrical drill motor or the like, in this way a turning motion may be applied to the threaded shaft via the socket and drill (or other manual turning mechanism) to cause the lifting assembly to exert a lifting force on the inner bollard tube. Since this lifting force is assisted by the urging force acting upon the inner bollard tube from the urging member(s), in the vertical upward direction, only a relatively small turning force is required to be applied to head end of the threaded shaft to achieve the lifting of the inner bollard tube and, therefore, extension of the bollard assembly. Similarly, reversal of the turning direction applied to the head end of the threaded shaft serves to exert a lowering force upon the inner bollard tube via the lifting assembly, acting in reverse.

The at least one urging member may be arranged to exert an urging force which is insufficient substantially to lift the inner bollard member to the extended state. The urging member(s) may be arranged to provide collectively an urging force which corresponds to no more than the weight of the inner bollard member (including any attachments). The collective force may be between about 50% and 100% of that weight, or about 60% and 90% of that weight, or about 65% and about 85% of that weight.

The lifting apparatus may include a body member which is coupled to the outer bollard member and a limb member which is coupled to the inner bollard member and which is operable to retractably extend from the body member to exert said lifting force when so coupled. The body member may be the cylinder of a ram (e.g. hydraulic, pneumatic, electrical) or may be an element of a purely mechanical lifting mechanism. The limb member may be the rod of the ram, or a rod retractably extendable from the body member by purely mechanical action, such as a lead screw, power screw or translation screw assembly.

The inner bollard member may include a bore within which at least a part of the at least one urging member is located and coupled to the inner bollard member. For example, the urging means may be located adjacent the lifting apparatus within the bore of the inner bollard tube. Where the lifting apparatus includes the aforesaid body member and limb member, the urging means may be arranged to urge the limb member to extend from the body part in the direction associated with the lifting operation of the lifting apparatus thereby to assist in the bearing of the weight of the inner bollard member by the lifting apparatus.

The at least one urging member may be mounted upon the lifting apparatus independently of both the inner bollard member and the outer bollard member thereby to collectively define a retractably extendable unit detachably attached to both the inner bollard member and the outer bollard member concurrently. For example, the body member of the lifting apparatus (when of that type) may be detachably attached to the outer bollard member while the limb member is detachably attached to the inner bollard member. The urging means may be attached to the body member and separately attached to the limb member in such a way as to urge the limb member to extend from the body member. The urging means may be so attached without being directly attached to the bollard inner or outer members, and be indirectly attached thereto via the lifting apparatus.

In some embodiments, the lifting apparatus may be coupled to the at least one urging member and may be arranged to resist the urging force exerted by the at least one urging member to prevent movement of the inner bollard member towards the extended state unless said lifting force is also applied by the lifting assembly. For example, when arranged in the form of the retractably extendable unit described above, the lifting apparatus may include a means of preventing extension of the urging means independently of the lifting apparatus—as urged by the urging force exerted upon it by the urging means—thereby to hold the unit together. This may take the form of coupling between the urging means and the lifting apparatus, which obstructs, blocks or acts to prevent movement of the urging means relative to the lifting apparatus unless the lifting apparatus is operated to achieve that result. The coupling is preferably attached to the limb member of the lifting apparatus. For example, the lifting apparatus may include a coupling means via which the at least one urging means is decouplably coupled to the lifting apparatus and via which said urging force is applied to the lifting apparatus to urge the lifting apparatus to extend in a direction associated with its lifting operation. This may also be the direction of potential separation of the coupling means from the lifting apparatus. Thus, it may be important that the coupling means in question is not mistakenly removed so as to enable the potentially dangerously rapid extension of the urging means independently of the lifting apparatus. The coupling means may include obstruction means positioned to present a removable obstruction to access to the coupling means to prevent decoupling of the coupling means from the lifting apparatus. The removal of the obstruction means is preferably obstructed by an at least one urging means. When the lifting apparatus comprises a lead screw (e.g. a said limb member), the coupling means may be a holding nut applied to the lead screw to hold upon the shaft of the lead screw an interface means for coupling the urging means to the lead screw. Thus the lead screw may hold the urging means in the urging (e.g. compressed) state via the interface means by virtue of the holding nut which blocks removal of the interface means from the lead screw. The same principle applies to other than the shafts of lead screws (e.g. the shaft of a hydraulic, pneumatic or electrical ram when used as lifting means etc). The obstruction means may be a plate which prevents the access required to remove the holding nut. By requiring urging means to be removed from the unit to enable access for removing the holding nut, the dangerously rapid separation urged by the urging means, as described above, is removed.

The lifting assembly may comprise a lead screw coupled to the inner bollard member and a nut coupled to the outer bollard member and arranged to engage the lead screw to translate turning motion of a lead screw into linear motion thereof through the nut. A lead screw is intended to refer to at least a screw designed to translate turning motion into linear motion. A lead screw is also known as a power screw, translation screw, also covering ball screw and roller screw (e.g. planetary roller).

Preferably the screw threading of the lead screw is a trapezoidal thread or a so-called "Acme thread", but may be a square thread or other suitable lead screw, power screw or translation screw thread as would be readily apparent to the skilled person. The outer diameter of the lead screw bearing the is preferably in the range 20 mm to 30 mm, and most preferably about 25 mm in diameter. The pitch between successive screw threads of the lead screw (e.g. the distance along the lead screw's axis traversed by one rotation in the nut) is preferably about 5 mm to 10 mm (e.g. 5 mm to 6 mm) but may be in the range of about 3 mm to 12 mm pitch.

The lead screw may be coupled to the inner bollard member and the nut may be coupled to the outer bollard member such that said lifting force is generated by action of rotation of the lead screw relative to the nut.

The bollard apparatus may include a guide bore of non-circular cross-sectional profile to which the lead screw is rotatingly secured to extend therealong to pass through the nut, and said nut is secured to said body part which extends into the guide bore to slidingly interface with the guide bore when the guide bore is moved relative to the nut by action of said rotation. The body part is shaped preferably to reciprocally match at least a part of the non-circular cross-sectional profile of the guide bore to prevent rotation of the lead screw relative to the nut by action of rotation of the inner bollard member relative to the outer bollard member.

The lifting apparatus may comprise hydraulic means adapted to generate said lifting force hydraulically. Alternatively, the lifting apparatus may comprise pneumatic means adapted to generate said lifting force pneumatically. Alternatively, the lifting apparatus may comprise electro-mechanical means adapted to generate said lifting force electro-mechanically.

The urging means may comprise one or more gas struts. The gas struts may be arranged such that the force exerted by each gas strut is, for example, between 100 N and 500 N, depending upon the weight of the inner bollard member. The force applied by the gas strut(s), e.g. collectively when a plurality are employed, may be between about 70% and about 100% of the weight of the inner bollard member and its attachments over the stroke length of the gas strut. For example, it may be about 75% over the stroke length on average. For example, the gas strut(s) may (e.g. collectively) counter-balance about 80% of the inner bollard weight when the inner bollard tube (and gas struts) are retracted, and about 70% of that weight when the inner bollard tube (and gas struts) are fully extended.

This means that the load upon the lifting apparatus may be about 20% of the weight of the inner bollard member as the member is un-extended or initially extended, rising to 30% when fully extended.

The inner bollard member may include a bore within which the lifting apparatus is housed concurrently within the bore of the outer bollard member wherein the inner bollard apparatus includes a through-opening at a terminal end of the inner bollard member permitting external access to the lifting apparatus within the bore thereof, and a cover means moveable from a releasably securable position which covers the through-opening to a position which reveals the through-opening.

The bollard apparatus may include a removable plate part releasably coupled to the terminal end of the inner bollard member via a coupling interface achievable by steps including rotating the removable plate relative to the terminal end of the inner bollard member, wherein the cover means is adapted to obstruct rotation of the removable plate from the coupling interface when in said releasably securable position, and to permit rotation of the removable plate from the coupling interface when in said position which reveals the through-opening.

The inner and outer bollard members are preferably made of a tough metal such as steel (e.g. mild steel or the like).

Accordingly, the invention may provide a retractable bollard including the bollard apparatus described above, being retractably extendable by retractably extending the inner bollard member relative to the outer bollard member using said lifting apparatus.

The bollard apparatus may provide, or form a part of, a vehicle impact barrier.

It is envisaged that the invention may be manufactured and sold in disassembled form, such as in the form of a kit of parts for assembly into the bollard apparatus.

In a second of its aspects, the invention may provide a kit of parts for a bollard apparatus comprising: an outer bollard member comprising a bore; an inner bollard member at least a part of which is adapted to be located within said bore to be moveable along the bore from a retracted state in which at least some of the inner bollard member is located within the bore to an extended state in which less of the inner bollard member is located within the bore; at least one urging member adapted to exert an urging force upon the inner bollard member to urge the inner bollard member towards the extended state; a lifting apparatus adapted to be coupled to the inner bollard member and operable to exert a lifting force thereupon sufficient to lift the inner bollard to the extended state when also subject to the urging force.

Embodiments of the invention shall now be described by way of non-limiting example only, with reference t the accompanying drawings of which:

Figure 3A:
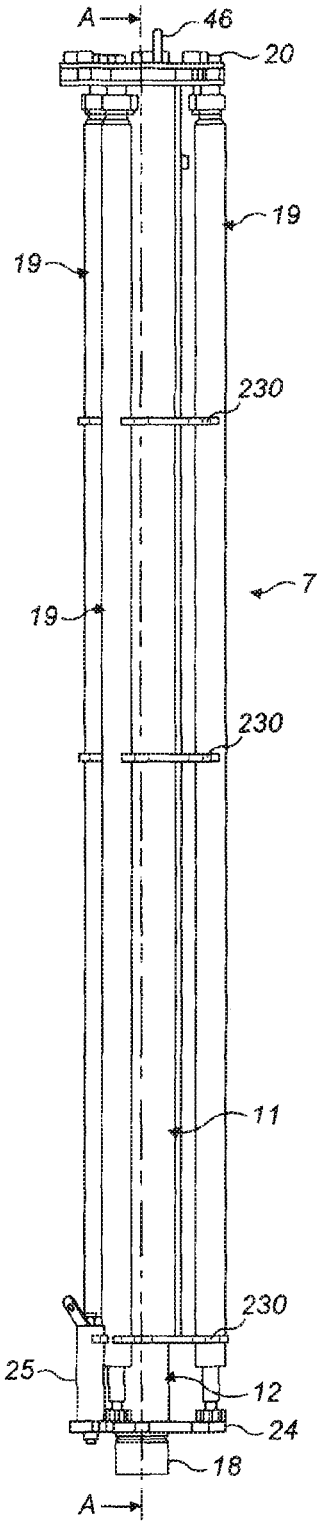
FIG. 3A illustrates a side view of the lifting apparatus and gas struts internal to the bollard apparatus of FIGS. 1A, 1B and 2.
Figure 3B:
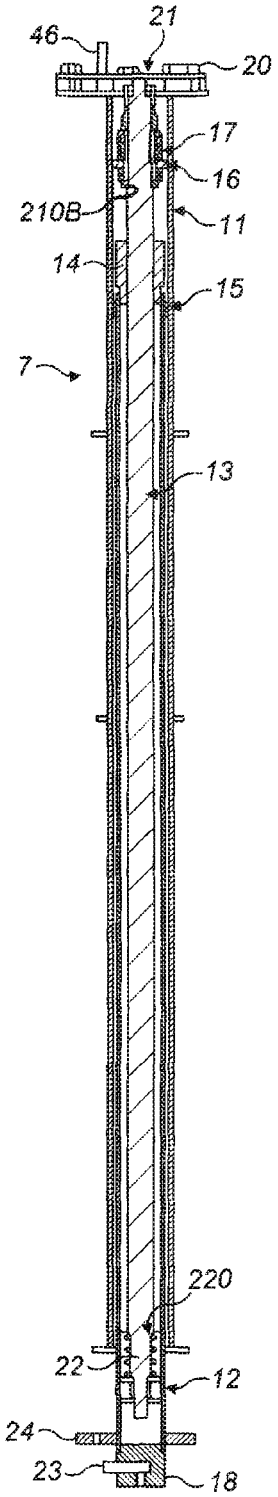
FIG. 3B illustrates a cross-sectional view of the lifting apparatus of FIG. 3A.
Figure 5:
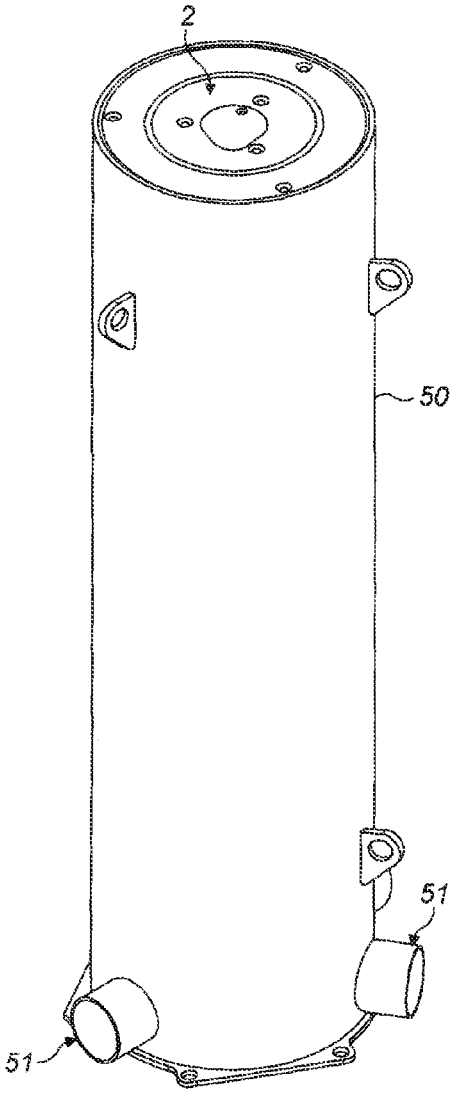
FIG. 5 illustrates a perspective view of the bollard apparatus of FIGS. 1A and 1B in which the bollard assembly is housed within an outer casing.
Figure 6:
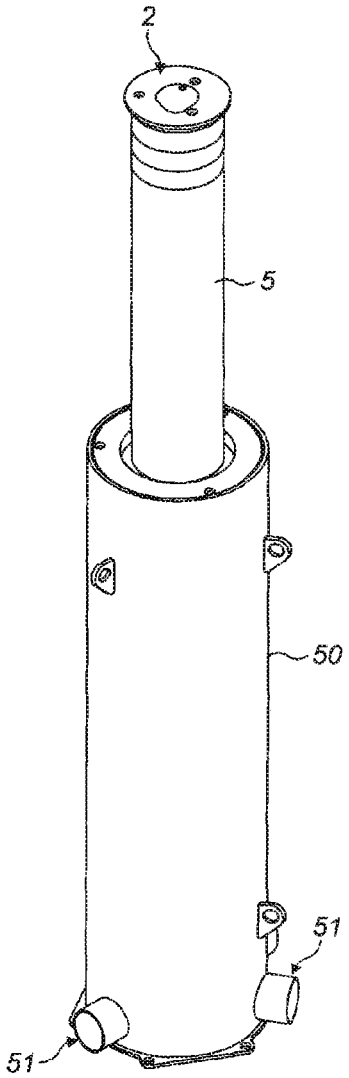
Figure 7A:
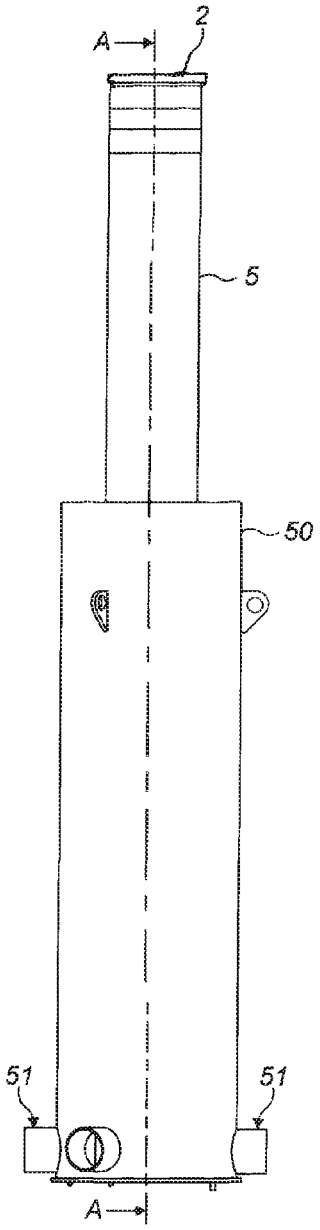
Figure 7B:
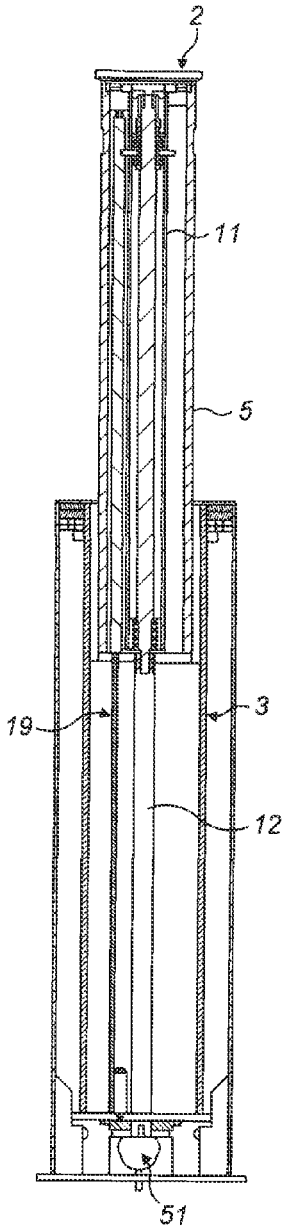
Figure 8:
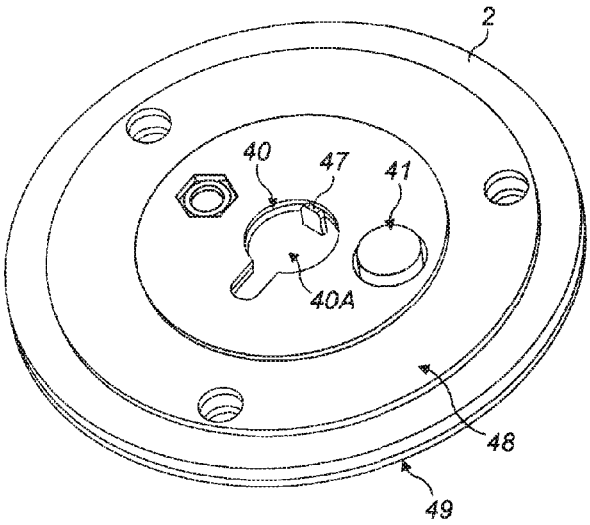
Figure 9:
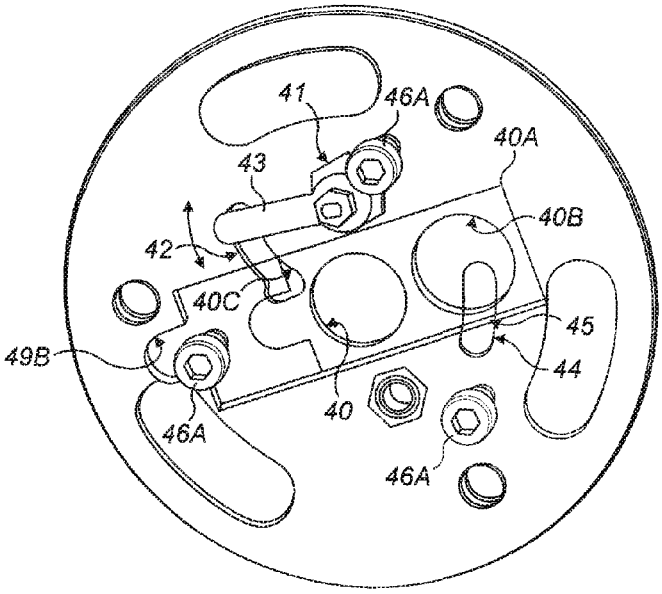
Figure 10:
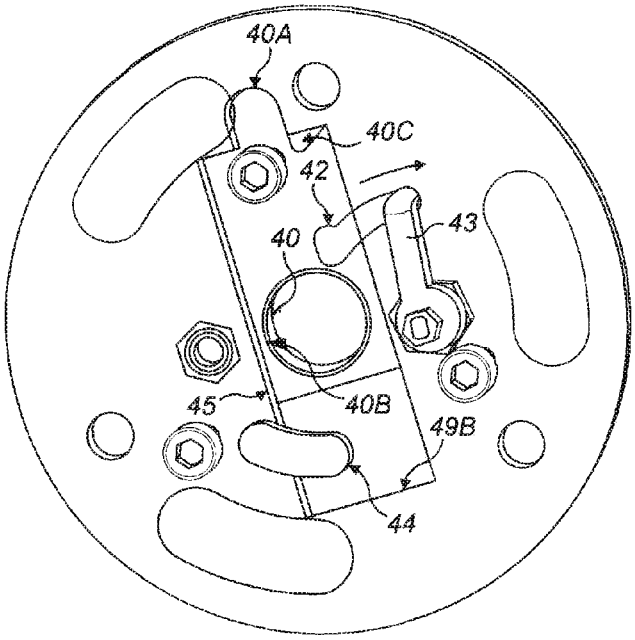
Figure 12:
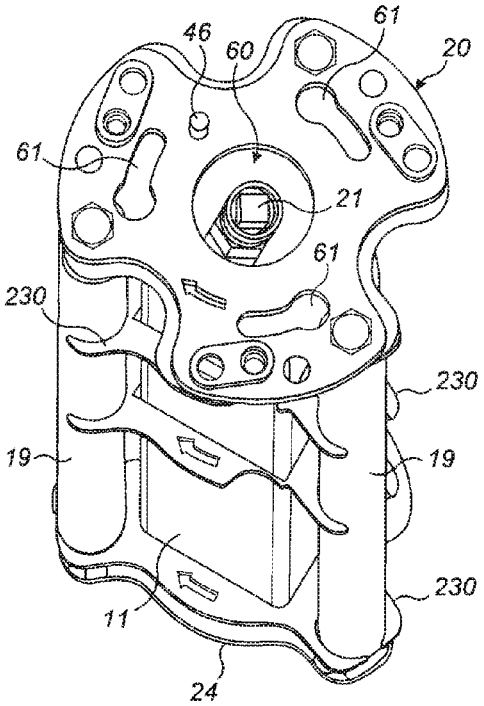
Figure 13:
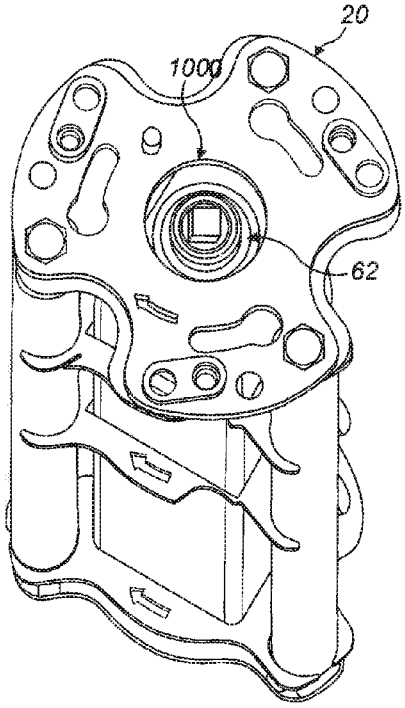
Figure 14:
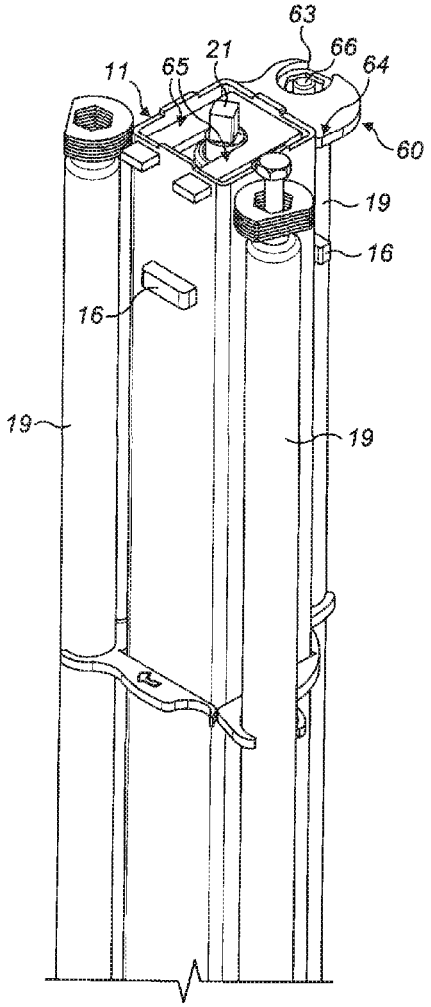
Figure 15:
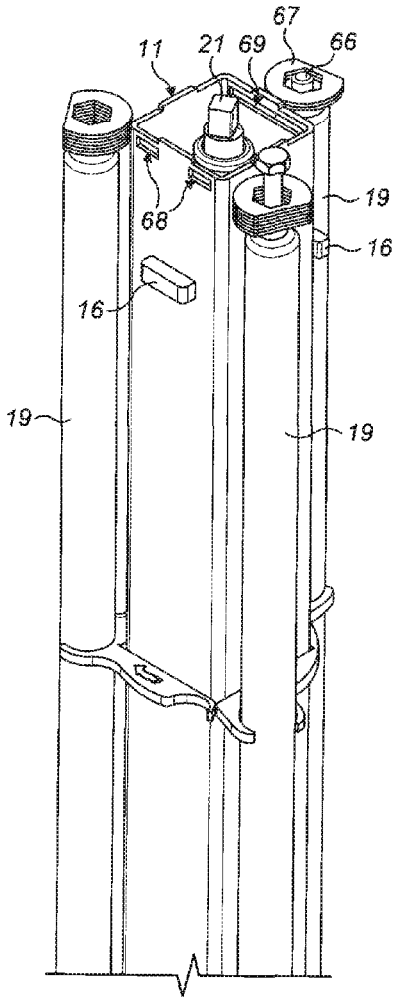
Figure 16A:
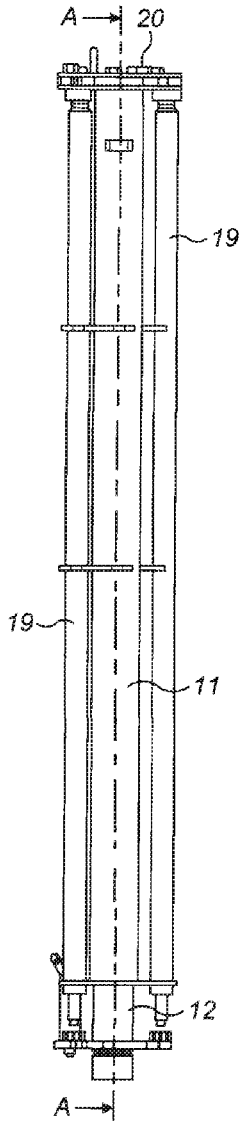
Figure 16B:
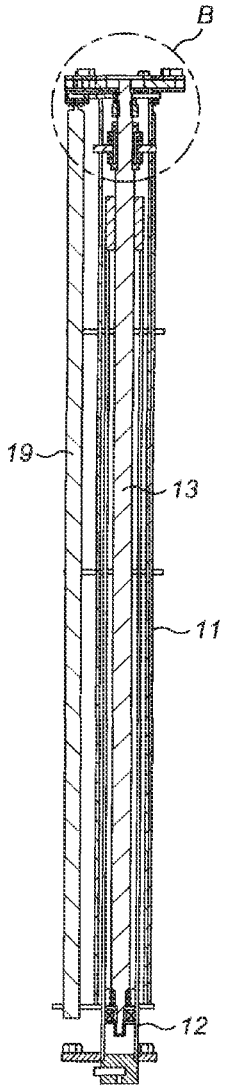
Figure 16C:
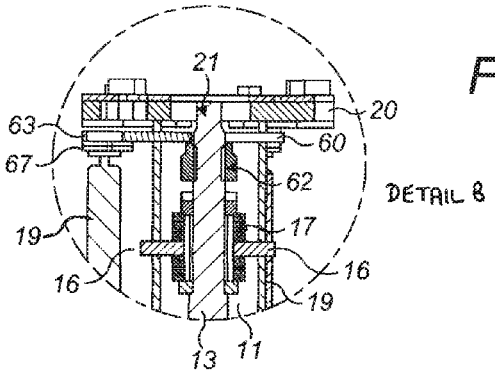
Figure 17A:
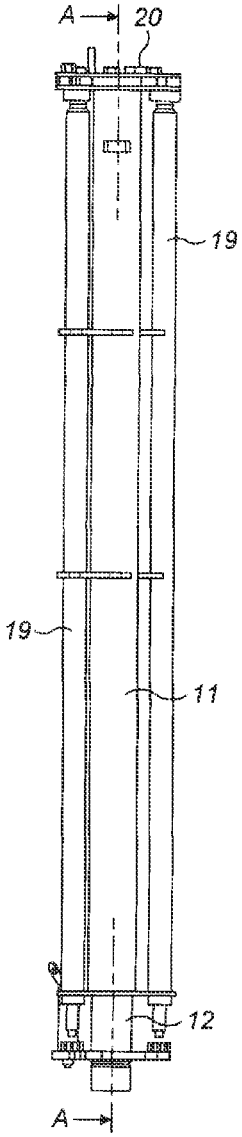
Figure 17B:
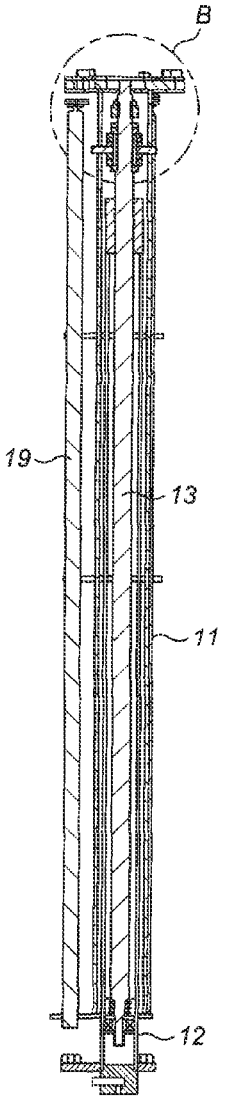
Figure 17C:
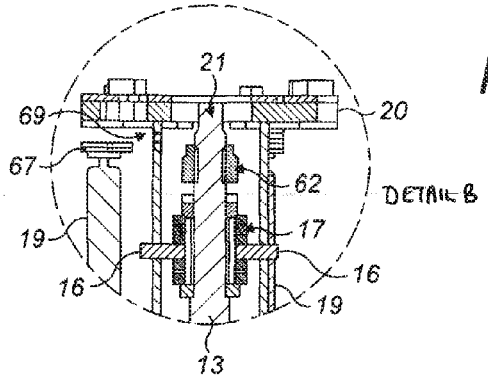
Figure 18A:
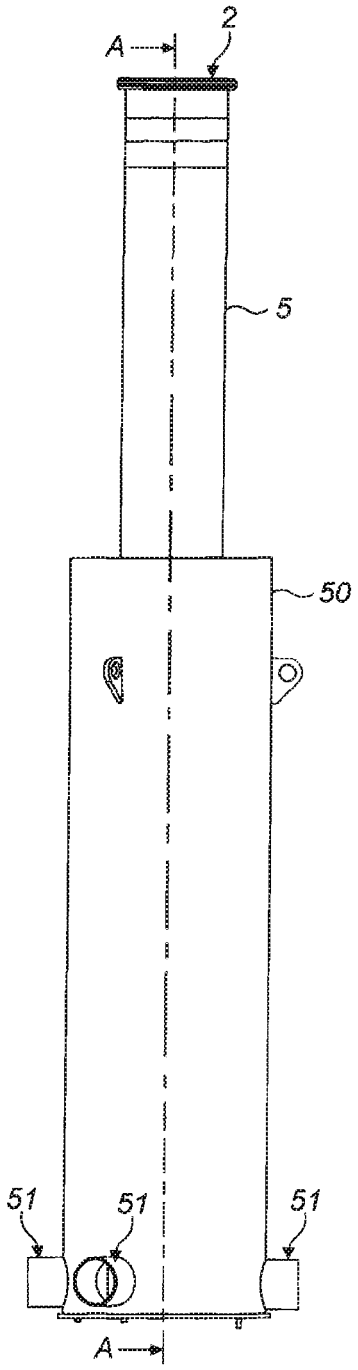
Figure 18B:
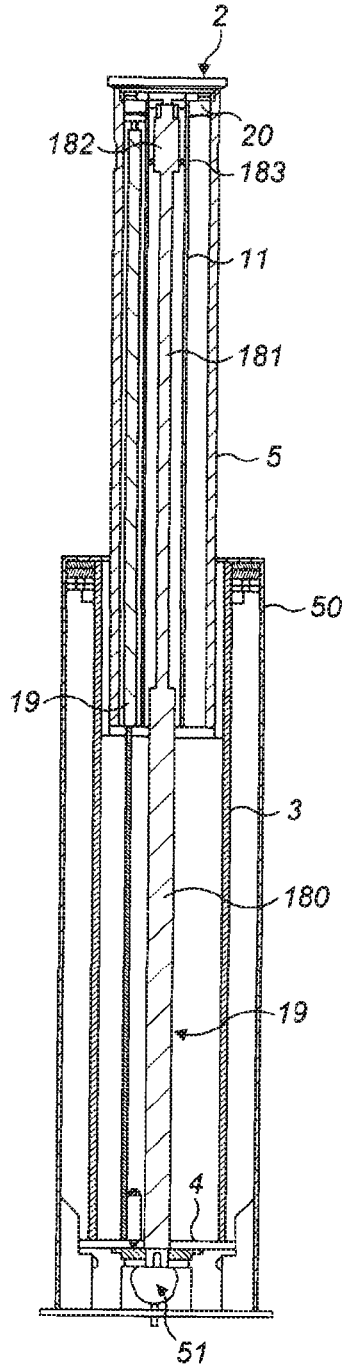

FIG. 6 demonstrates a perspective view of the bollard apparatus of FIG. 5 in the fully extended state;

FIGS. 7A and 7B show a side view and a cross-sectional view, respectively, of the encased bollard apparatus in the extended state;

FIGS. 8 to 11 illustrate views of a head end plate for the inner bollard tube of the bollard apparatus—FIGS. 9 and 10 are "transparent" views revealing internal structure;

FIG. 12 shows a perspective view of an alternative embodiment of the lifting apparatus of FIGS. 3A and 3B in which a removable obstruction plate (60) is provided and is shown in position;

FIG. 13 shows the view of FIG. 12 in which the removable obstruction plate is removed;

FIG. 14 shows a perspective view of the lifting apparatus of FIG. 12 in which the head end abutment plate (20) is removed (for clarity) to show the obstruction plate in place;

FIG. 15 shows the view of FIG. 14 in which the obstruction plate is removed;

FIGS. 16A, 16B and 16C show a side view, cross-sectional view (along line A-A), and magnified cross-sectional detail view, respectively of the lifting apparatus of FIG. 12;

FIGS. 17A, 17B and 17C show a side view, cross-sectional view (along line A-A), and magnified cross-sectional detail view, respectively of the lifting apparatus of FIG. 13;

FIGS. 18A and 18B show a side view and a cross-sectional view of a bollard apparatus in which the lifting assembly comprises a hydraulic, pneumatic or electro-mechanical ram.

In the drawings like articles are assigned to like reference numerals.

Figure 1A:
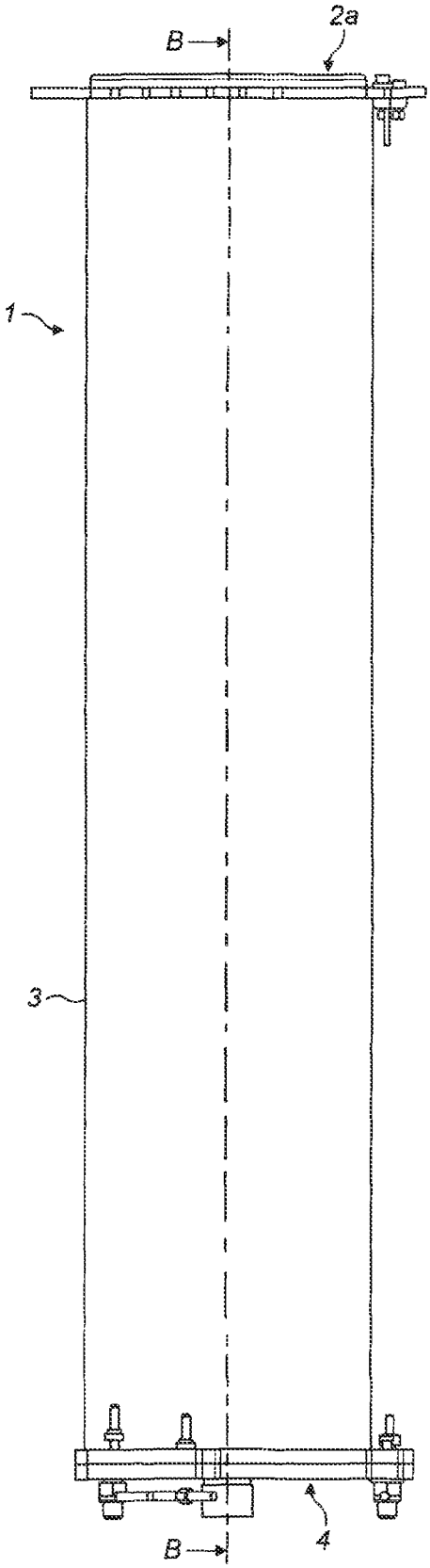
FIG. 1A illustrates a side view of a retractable bollard apparatus in the retracted state.
Figure 1B:
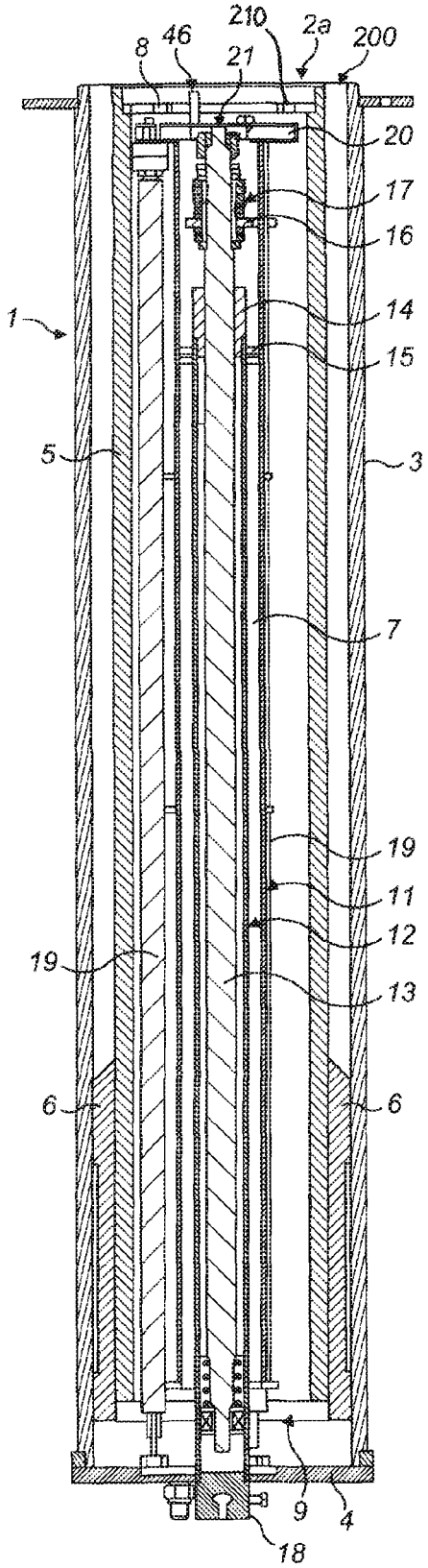
FIG. 1B illustrates a cross-sectional view of the bollard apparatus of FIG. 1A, viewed along the line B-B.

Referring to FIG. 1A and FIG. 1B, there is illustrated a side view and a cross sectional view (through Section B-B) of a bollard apparatus (1) comprising an inner bollard tube (5) within the linear circular bore of a hollow outer bollard tube (3). The inner bollard tube is arranged to move along the axis of the bore of the outer bollard tube from a retracted state (as shown in FIGS. 1A and 1B) in which some or all of the inner bollard tube is located within the bore of the outer bollard tube, to an extended state (e.g. see FIG. 2) in which a substantial portion of the length of the inner bollard tube extends outwardly of the top of the outer bollard tube through an end opening (200) formed therein for that purpose. The outer bollard tube extends from a base end which is closed and terminated by a base plate (4) to a head end defining the bore opening (200) through which the inner bollard tube is free to pass in either direction along the linear circular bore of the outer bollard tube. A collar member (6) securely embraces the outer tubular surface of the inner bollard tube at its base, circumferentially, forming an interference fit (welding may be employed). The collar member presents a sliding interface between the inner bollard tube and the bore of the outer bollard tube and holds the inner bollard tube in axial alignment along the longitudinal axis of the bore of the outer bollard tube.

Three gas struts (19) are each separately connected at their respective head ends via an upper abutment plate (20), to the inner bollard tube at a head end opening (2A) thereof via transversely projecting flanges (210) of a stop ring (8) secured to the inner tube bore. The flanges extend transversely into the bore of the inner bollard tube to be abutted by and connected to the upper abutment plate using bolts or the like. The head end opening (2A) is coverable by a head end plate (item 2, FIGS. 5 to 11) which is removeably fixed to the upper side of the upper abutment plate at the head end of the inner bollard tube and defines the top (in use) of the inner bollard tube (see FIG. 5). The head end plate defines an access opening in register with the head end opening via which access may be gained to lifting apparatus within the inner bollard tube to allow the lifting apparatus to be operated within the bollard from outside the bollard, by users. The accessible parts of the lifting apparatus include an interface portion (head end 21) shaped to interface with external apparatus (e.g. a crank/power tool) to transfer turning forces from the external apparatus to the lifting apparatus.

Figure 2:
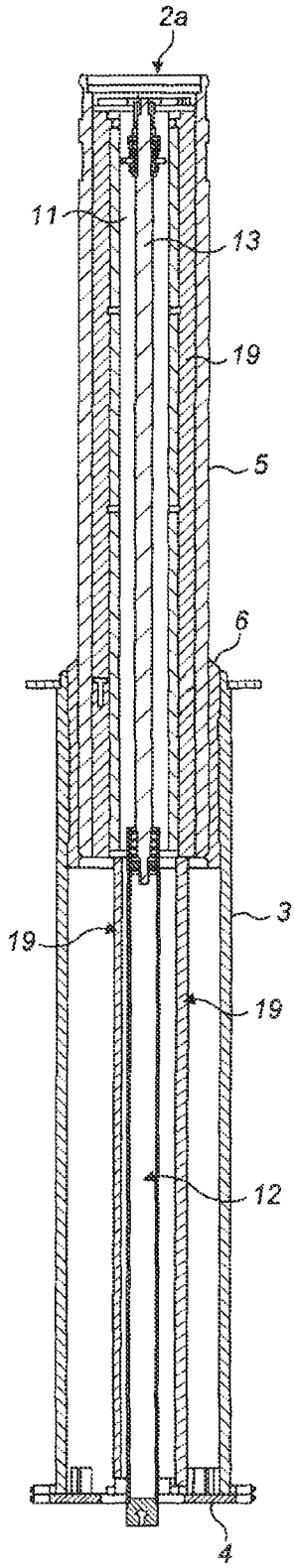
FIG. 2 illustrates a cross-sectional view of the bollard of FIG. 1A in the fully extended state.

Concurrently the base end of each gas strut, together with the lifting apparatus (13, 14 etc) extends out of the base of the inner bollard tube through a base opening there (19) and is subsequently connected to the base plate (4) of the outer bollard tube. Each of the three gas struts adopts a contracted or compressed state when the inner bollard tube is fully retracted into the bore of the outer bollard tube as illustrated in FIG. 1B, and each is adapted to adopt an extended state, as shown in FIG. 2, when the inner bollard tube is extended from the outer bollard tube. Each of the three gas struts is adapted perpetually to urge to adopt the extended state, as shown in FIG. 2, and, accordingly, is thereby adapted to exert an urging force upon the underside of the upper abutment plate (20) of the inner bollard tube thereby to exert an urging force to urge the inner bollard tube towards the extended state. Each gas strut is arranged to exert substantially the same urging force (both in magnitude and direction) against the upper abutment plate (20) for a given extension state of the struts, and the inner bollard tube. Each of the three gas struts is adapted and arranged such that the collective and combined urging force exerted by them is sufficient to act as an effective counter-weight to the weight of the inner bollard tubes but is insufficient to lift the inner bollard tube relative to the outer bollard tube in the vertical direction. Consequently, while the urging force exerted by the gas struts serves to reduce the effective vertical weight of the inner bollard tube, thereby requiring a lesser force to lift that inner bollard tube vertically, than would otherwise be the case, the inner bollard tube is unable to be lifted by struts relative to the outer bollard tube without an additional lifting force being applied.

The bollard assembly includes a lifting assembly (13, 14) located with, and extending along, the inner hollow bore of the inner bollard tube from the base plate (4) of the outer bollard tube to the upper abutment plate (20) of the inner bollard tube.

The lifting assembly comprises a linear, elongate lead screw (13) which is located coaxially with the longitudinal axis of both the outer bollard tube bore and the bore of the inner bollard tube concurrently. A head end (21) of the lead screw is coupled rotatingly to the upper abutment plate (20) of the inner bollard tube so as to permit the lead screw to turn, in a screw-type fashion relative to the inner bollard tube without otherwise moving (e.g. translational motion) relative to the inner bollard tube. The outer cylindrical surface of the lead screw is threaded with a trapezoidal threading along most of its length between its head end (2) to its base end nearest the base plate (4) of the outer bollard tube. The lifting assembly further comprises a nut (14) which is coupled to the base plate (4) of the outer bollard tube via a mounting tube (12) at the head end of which the nut is firmly secured.

The nut is internally threaded with a thread adapted to engage the external thread of the lead screw. The nut is positioned and adapted to engage the lead screw to translate turning motion of the lead screw into linear motion of the lead screw through the nut. Because the lead screw is coupled to the inner bollard member and the nut is coupled to the outer bollard member, a turning motion of the lead screw within the nut may be translated into a lifting force (or a lowering force if rotation is reversed) with which to exert a lifting force upon the inner bollard tube to lift the inner bollard tube to the extended state (as illustrated in FIG. 2) when the inner bollard tube is also subject to the urging force applied by the three gas struts (19) acting upon it.

The centre of the upper abutment plate (20) of the inner bollard tube comprises a through-opening defining an access opening (see item 1000, FIG. 13) permitting access to the head end (21) of the lead screw to allow a turning force to be applied to the lead screw at that end from above, in use. The head end of the lead screw is square in cross-sectional profile and adapted to be received within the head socket of the type used with a socket wrench. The head socket may be powered manually via a mechanical wrench or electrically via a hand-held electrical drill or the like. In either case rotational power is generated externally from the bollard assembly. By coupling the head end of the lead screw (21) to an electrical drill motor or the like, in this way a turning motion may be applied to the lead screw via the socket and drill (or other manual turning mechanism) to cause the lifting assembly to exert a lifting force on the inner bollard tube. Since this lifting force is assisted by the urging force acting upon the inner bollard tube from the gas struts, in the vertical upward direction, only a relatively small turning force is required to be applied to head end of the lead screw to achieve the lifting of the inner bollard tube and, therefore, extension of the bollard assembly. Similarly, reversal of the turning direction applied to the head end of the lead screw serves to exert a lowering force upon the inner bollard tube via the lifting assembly, acting in reverse. The inner bollard tube may be retracted into the outer bollard tube in this way when desired. By virtue of the counter-weight applied by the gas struts, the weight (and friction) experienced at the threads of the lead screw and nut is significantly reduced.

FIGS. 3A and 3B illustrate a side view and a cross-sectional view (through a cross-section A-A) of the gas struts (19) and the lifting assembly (11, 12, 13, 14) in more detail, as a part of a detachable unit (7) including the three gas struts (19).

Three linear elongate gas struts (19) are arranged in a regular circumferential spacing around a central lifting assembly. A lower abutment plate (24) extends from the sides of the lifting assembly at its base, transversely from the axis of the lifting assembly. The base end of each gas strut is attached to the lower abutment plate. In particular, each gas strut comprises a gas-filled cylinder within and against the bore of which a piston is slideably mounted upon the end of a piston shaft which itself extends along the cylinder and outwardly of one end of the cylinder of the gas strut. Gas conduits pass through the piston to allow communication of gas between the sections of the cylinder separated by the piston. The gas within the cylinder is pressurised equally either side of the piston such that a net force is applied by the gas acting upon opposite piston faces—a greater piston surface area being presented at the shaft-free side of the piston face than at the shaft-bearing side (opposite) of the piston—to urge the shaft outwardly of the cylinder to extend the gas strut. In this way, the gas strut perpetually urges to an extended state. The urging force increases when/as the gas strut is compressed and a greater proportion of the shaft is located within the gas cylinder thereby reducing the free volume of the cylinder and the gas within it (either side of the piston) thus increasing pressure overall, and particularly increasing the pressure differential between opposite faces of the piston.

The piston shaft of each gas strut is attached to the lower abutment plate (24). The terminus of the gas cylinder of each gas strut at the opposite terminal end of each gas strut concurrently abuts (being optionally connected to) the underside of the upper abutment plate (20) which extends from the body of the lifting assembly transverse to its longitudinal axis. Strut supports (230) extend from the outer surface of the lifting assembly and define recesses shaped and adapted to snugly hold the outer elongate cylinder surface of respective gas struts to support and position the struts in parallel with each other and with the axis of the lifting assembly along the length of the assembly in regular circumferential array around that axis. In this way, the urging force collectively exerted by the three gas struts is evenly distributed axially around the axis of the lifting assembly and against the underside of the upper abutment plate (20). This prevents uneven loading and minimises or prevents a tilting or torque being generated at the upper or lower abutment plate by the gas struts.

The gas struts are each constructed and arranged to generate sufficient force to substantially match or approximately match about one quarter to one third of the weight of the inner bollard tube, in the vertical direction, with the lifting assembly coupled to it as described in more detail below. The urging force of the gas struts combined may be less than the opposing weight against which they urge. In general, it is desirable that the combined urging force is close to or comparable to the opposing weight such that the opposing weight is significantly reduced, and may even be nearly or effectively rendered "weightless" to the lifting apparatus, so that little or a significantly reduced load is necessary to be applied, between the lead screw (13) and the nut (14) interacting with it, to lift the inner bollard tube. The result is that relatively little, or a significantly reduced, turning force is required to be applied to the head end (21) of the lead screw in order to generate the lifting force required to lift the weight of the inner bollard tube and its attachments.

The force exerted by each gas strut is, for example, between 300 N and 350 N (alternatively, less or more depending upon the size and weight of the inner bollard tube). The collective force applied by the three gas struts may be between about 70% and about 100% of the weight of the inner bollard tube and its attachments over the stroke length of the gas strut, example about 75% over the stroke length on average. For example, the gas struts may collectively counter-balance about 80% of the inner bollard weight when the inner bollard tube (and gas struts) are retracted, and about 70% of that weight when the inner bollard tube (and gas struts) are fully extended.

This means that the load upon the lead screw may be about 20% of the weight of the inner bollard tube as the tube is un-extended or initially extended, rising to 30% when fully extended.

Preferably the screw threading of the lead screw is a trapezoidal thread or a so-called "Acme thread", but may be a square thread or other suitable lead screw, power screw or translation screw thread as would be readily apparent to the skilled person. The outer diameter of the lead screw (13) bearing the threading (not shown) is preferably in the range 20 mm to 30 mm, and most preferably about 25 mm in diameter. The pitch between successive screw threads of the lead screw (e.g. the distance along the lead screw's axis traversed by one rotation in the nut) is preferably about 5 mm to 6 mm, but may be in the range of about 3 mm to 12 mm pitch. This range of pitch, combined with the range of lead screw rod diameter described above, has been found to produce a desirable result. It is to be noted that while more mechanically advantageous, efficient or "faster" lead screw pitches may be adopted (and other embodiments of the invention may adopt such faster pitches if desired), it has been found preferable to employ the aforementioned pitch and lead screw diameter ranges in order to avoid the well-known problem of "back-driving" which can occur in lift mechanisms employing lead screws and the like. The efficiency of the lift mechanism, and the lead screw apparatus within it, has been found in this way to be sufficiently low to avoid back-driving, yet sufficiently high to require only minimal turning force to be applied to head-end of the lead screw (21) to achieve relatively easy translation of that turning motion into a linear lifting (or lowering) motion. For example, a simple relatively small hand-held electrical power drill may be employed with a suitably shaped wrench socket to apply a modest turning force to the lead screw head end to achieve this result. This enables quick, simple and easy operation of the bollard apparatus to raise and lower the inner bollard tube without requiring any of the electrical, hydraulic or pneumatic power systems that might otherwise be required to be housed within a bollard assembly to power the raising and lowering of a retractable bollard.

For example, the length of the inner bollard tube may be of the order of 1 meter and so can be quite substantial weight when made from steel or the like (e.g.) 100 kg or thereabouts) as might be required if the bollard apparatus is to be employed as an impact barrier or such like. Such a heavy inner bollard tube would be very difficult indeed (probably dangerously difficult) to lift manually were it not for the presence of the lifting assembly and assisting gas struts described herein. While the present embodiment employs gas struts, other force-urging mechanisms may be used instead or in addition. Examples of alternatives include gas springs, mechanical springs or the like, secured between the upper and lower abutment plates (20, 24) in place of gas struts, to be compressed when the inner bollard tube is retracted.

Referring again to FIG. 3B in more detail, the lifting assembly comprises a telescopic tube arrangement being an elongate box-section outer tube (11) attached at its top end to the upper abutment plate (20) and terminating at its lower end with a through-opening providing access to the inner square bore of the outer box-section tube. An inner box-section tube (12) extends into and along the square inner bore of the outer box-section tube in close proximity therewith via a sliding interface bearing (15) which intimately interfaces with the inner bore surface of the outer box-section tube (11). The inner box section tube terminates at its upper most end with the nut (14) of the lifting assembly which is fixed to that terminal top end. The lead screw (13) is rotatingly attached to the inner bore of the outer box-section tube (11) via a rotation bearing assembly (16, 17) which itself is rigidly attached to the inner bore of the outer box-section tube via radial attachment flanges (16) and which comprises an inner rotation bearing bore (17) through which the lead screw (14) extends and is mounted to be freely rotatable about its axis and about the axis of the rotation bearing (17).

The head-end (21) of the lead screw extends through the upper end of the bearing assembly and the through-opening (40) at the top end of the outer box-section tube and the upper abutment plate (20). The rest of the lead screw extends downwardly through the lower opening of the rotation bearing (17) and extends lineally along the axis of the outer box-section tube (11) through the nut (14) with which it engages via the reciprocal threading therebetween, and subsequently further extends downwardly out through the base of the nut and into the inner bore of the inner box-section tube (12) substantially along almost the entire length of the inner box-section tube. Accordingly, the inner box-section tube is of a length sufficient to accept the length of the lead screw required to be received when the inner bollard tube is in the fully retracted state.

The trapezoidal threading on the outer cylindrical surface of the lead screw (not shown) extends from an upper shoulder (210B) of the lead screw upon which the lower end of the rotation baring (17) rests, to a lower shoulder (220) against which a damping mechanism (22) urges.

By turning the lead screw in the appropriate direction, the lead screw is enabled to rotate relative to the outer box-section tube (11) and the inner box-section tube upon which the nut (14) is mounted. Consequently, the rotational motion of the lead screw is translated, by the nut (14), into a translational motion which acts to lift the lead screw, the outer box-section tube (11) and the upper abutment plate (20) connected to it, relative to the nut, the inner box-section tube upon which it is mounted and the outer bollard tube. This may continue until the lowermost threaded end of the lead screw adjacent the lower shoulder (200) approaches the lower terminal end of the nut (14) which extends across the peripheral parts of the bore of the inner box-section tube. At that position, the damping assembly (22) is brought into contact with the lowermost end of the nut (14) to generate a force which urges against continued upward linear movement of the lead screw as will be described in more detail with reference to FIG. 4.

Figure 4:
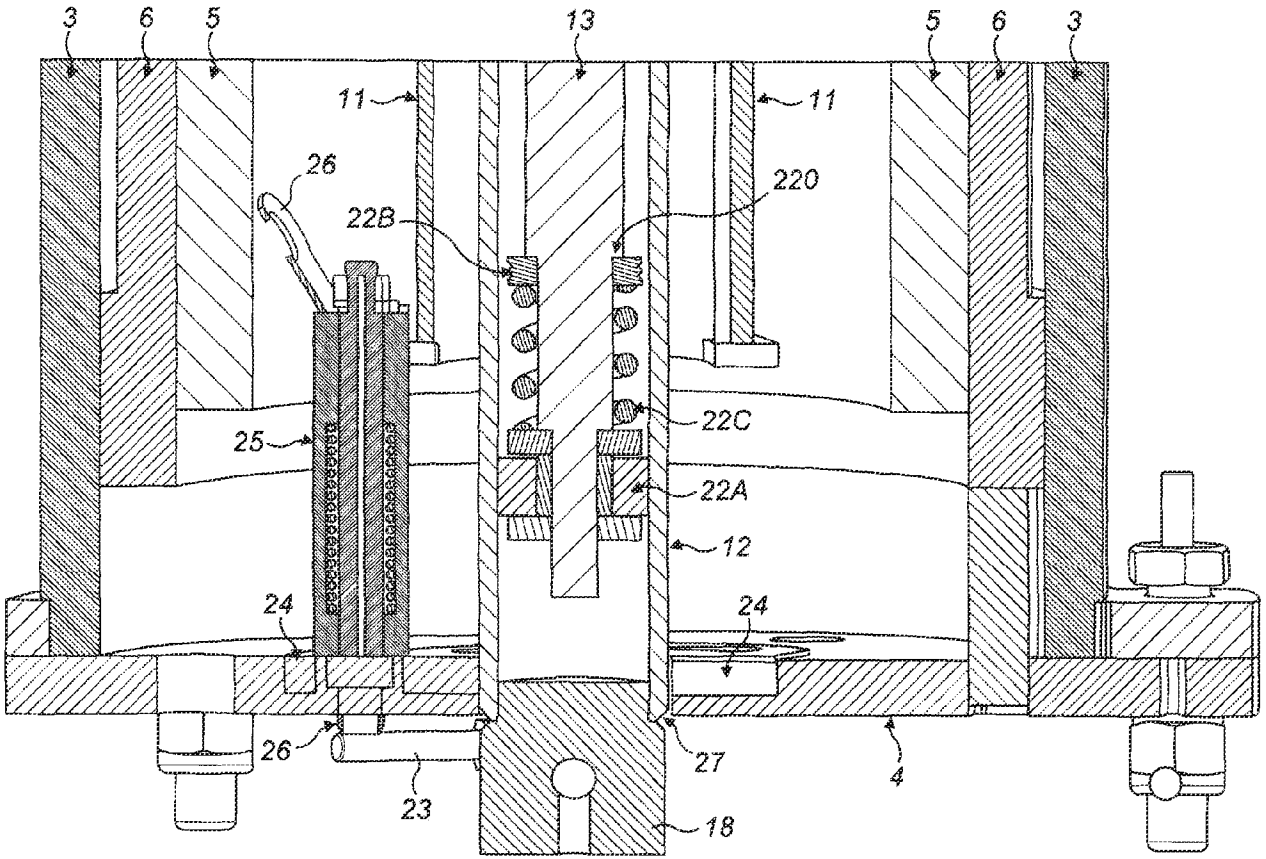
FIG. 4 shows a magnified cross-sectional view of the base end of the retracted bollard apparatus of FIG. 1B.

Referring to FIG. 4, the damping mechanism (22) comprises a slide bearing ring or washer (22A) fixed to a lowermost end of the lead screw. The slide bearing ring is sandwiched between two nuts which are screwed onto the lowermost threaded end of the lead screw (threading not shown) at opposite sides of the slide bearing ring. The slide bearing ring is shaped to slidingly interface closely with the inner bore of the inner box-section tube (12) to assist in the sliding action of the lead screw within that bore whilst maintaining the coaxial alignment of the lead screw within that bore. An abutment washer (22B) is urged against the lower shoulder (220) of the lead screw by a helical spring (22C) retained and held between the abutment washer and the slide bearing ring (22A) fixed to the lowermost end of the lead screw. In this position, the spring (22C) is in the compressed state and thereby urges the abutment washer (22B) against the lower shoulder (220). The abutment washer (22B) has an outer diameter exceeding the outer diameter of the lead screw and the lateral extent of the shoulder portion (220) such that when the lowermost end of the lead screw is brought into proximity with the lower surface of the nut (14) as the inner bollard tube is fully extended, the abutment washer (22B) is brought into abutment with and is urged against, that lowermost nut surface. Continued rotation of the lead screw in such circumstances will lead to continued upward linear movement of the lead screw so as to compress the spring of the damping mechanism (22C) such that, gradually and relatively smoothly, a successively greater rotational force becomes necessary in order to continue lifting the inner bollard tube. The result is a gentle "stop" to rotation of the lead screw when the inner bollard is fully extended rather than a sharp and potentially damaging stop or impact which maybe harmful to the lifting assembly and to the rotational device (e.g. hand-held electrical drill mechanism) used to apply the rotational force to the lead screw.

The nut (14) of the lifting assembly is attached to the base plate (4) of the outer bollard tube via the inner box-section tube (12) of the lifting assembly and subsequently via the lower abutment plate (24) extending laterally from the lowermost end thereof. A spring-loaded pin mechanism (25) is attached to the lower abutment plate (24) and is adapted to retractably present a pin (26) to project outwardly from the lowermost surface of the lower plate plate (24) when not in the retracted state. A through-opening is formed in the base plate (4) of the outer bollard tube which is positioned and dimensioned to accept the pin (26) of the spring-loaded pin mechanism (25) when the former is placed in register with the latter. This is arranged to occur when the lifting assembly is correctly axially aligned with the axis of the bollard assembly and inner and outer bollard tubes. Once so positioned in register, the extended pin (26) of the lifting assembly enters the receiving through-opening of the base plate (4) of the outer bollard tube to prevent rotation of the inner box-section tube (12) relative to the outer bollard tube (3). Because the outer box-section tube (11) is also of box-section nature and has an inner bore which intimately receives the inner box-section tube (12), the two box-section tubes cannot be rotated relative to each other. Consequently, a rotational force applied to the inner bollard tube assembly to which the outer box-section tube is fixed, cannot cause a consequential rotation of the lead screw (13) relative to the nut (14) through which it passes. This is because any rotation of the inner bollard tube, and consequential rotation of the outer box-section tube (11) is immediately also applied to the inner box-section tube (12) and to the nut (14) mounted upon it.

As a result of this, it is not possible to lower the inner bollard tube relative to the outer bollard tube simply by rotating the inner bollard tube to cause the lead screw (13) to rotate relative to the nut (14). This might otherwise be the case were it not for the box-section structure of the lifting assembly.

FIG. 5 shows a perspective view of the bollard assembly of FIGS. 1A and 1B in which the bollard assembly is housed within an outer casing (50). The base of the casing presents inlet/outlet ducts (51) which are adapted to allow electrical, hydraulic or pneumatic cables to pass to and from the inner volume of the casing in those cases or embodiments in which the lifting assembly comprises a pneumatic, hydraulic or electro-mechanical lifting mechanism, instead of the purely mechanical lifting mechanism described with reference to FIGS. 1 to 4.

FIGS. 18A and 18B alternative embodiments in which the lifting assembly is not a lead screw and nut, but is a pneumatic, hydraulic or electro-mechanical lifting mechanism (180, 181, 182) comprising a ram. The ram includes a body (180) attached to the base plate of the inner bollard tube (3) housed within the outer casing (50). The body may comprise a hydraulic or pneumatic cylinder (when a hydraulic or pneumatic ram) containing the piston-bearing end (not shown) of a piston-bearing rod (181) subject to internal hydraulic/pneumatic forces to move the rod. The body may contain an electro-mechanical mechanism for converting electrical energy into lineal movement of the rod (181) by means such as would be readily apparent the skilled person. Electrical, pneumatic or hydraulic drive means, pumps and other peripheral devices (not shown) for energising the ram may be housed within the outer casing. Power cable, fluid or gas lines (as required) may be fed to the ram via inlet/outlet ducts (51) at the base of the casing (50).

The ram is operable, when energised, to move the rod (181) linearly to extend or retract from the body (180) of the ram to exert a lifting force or lowering force, respectively, to the inner bollard tube. The ram may be controlled simply to remain in a static state of extension to support the inner bollard tube in a correspondingly static state of extension.

The terminal head end region of the rod (182) is connected to the outer guide tube (11, which need not be box-section in this embodiment) via a transverse coupling flange (183) such that linear movement of the ram rod (181) is transferred to corresponding movement of the guide tube (11) and the upper abutment plate (20) against which the three gas struts (19) each concurrently urge as described above. In this way, a relatively weak ram may be employed to provide the required lifting force to lift the inner bollard tube and attachments, being assisted by the counter-weight effect of the urging force supplied by the gas struts.

FIG. 6 demonstrates a perspective view of the bollard assembly, within the casing, in the fully extended state in which the inner bollard tube is extended from the outer bollard tube (not visible) which is located within the casing.

FIGS. 7A and 7B, or 18B in the alternative, show a side view and a cross-sectional view, respectively, (along axis A-A) of the cased bollard apparatus in the extended state.

FIG. 8 illustrates in detail the structure of the head end plate (2) of the inner bollard tube which comprises a sliding cover plate (40A) slidingly moveable to reveal or cover (selectively) the through-opening (40) in the head end plate via which the head end (21) of the lead screw is accessable as described above. The sliding cover plate (40A) is manually manipulable via an upstanding flange (47) constructed and arranged from frangible or relatively easily breakable/snapable material such that application of a sufficiently large horizontal force to the flange will break the flange from the surface of the cover plate without the cover plate being moved from a position (as shown in FIG. 7) covering the through-opening. This is an anti-tamper provision which protects the contents of the inner bollard tube from an authorised access via the through-opening. A locking mechanism (41) is operable to unlock and release the sliding cover plate (40A) to enable manual manipulation of the flange (47) to slide the cover plate laterally to reveal and uncover the through-opening. A radial notch is formed in the periphery of the through-opening and is dimensioned to accept the flange (47) when the cover plate is fully retracted from covering the through-opening. The head end plate (2) comprises an upper plate member (48) and a lower plate member (49) through which the through-opening (40) passes and between which the sliding cover plate (40A) is slidingly sandwiched.

The locking mechanism (41) comprises a key-operated barrel lock which extends through the upper plate member and outwardly from the underside of the lower plate part (49) into the hollow of the inner bollard tube when positioned in use. This is demonstrated in FIGS. 9, 10 and 11.

Figure 11:
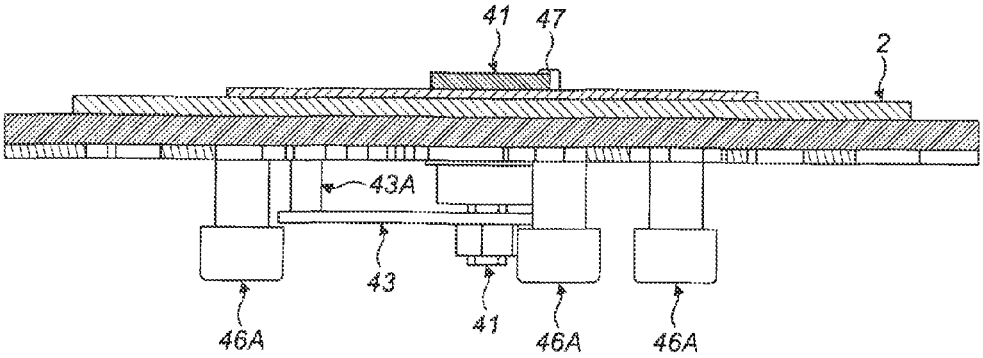

Referring to FIGS. 9, 10 and 11 in detail, the lock mechanism (41) comprises a transverse arm (43) which extends laterally from the side of the lock mechanism projecting from the underside of the lower plate member (49) of the head end plate (2). An obstruction pin (43A) extends transversely from the axis of the transverse arm (43) towards the head end plate (2) and extends into an arcuate slot (42) cut within the body of the lower plate member (49) of the head end plate (2). The radius of curvature of the arcuate slot coincides with the radial length of the transverse arm (43) from the obstruction pin to the rest of the lock mechanism (41) to which the transverse arm is attached at its other end. This means that operation of the lock mechanism causes the transverse arm (43) to rotate about the longitudinal axis of the lock mechanism to cause the transverse pin (43A) to revolve about the axis of the lock mechanism (41) within and along the arcuate slot (42).

In the un-locked position illustrated in FIGS. 9 and 10, the obstruction pin is positioned at one end of the arcuate slot furthest from the through-opening (40), whereas operation of the lock mechanism may move the obstruction pin to the other end of the arcuate slot near most the through-opening (40) in order to lock the sliding cover plate (40A) in the position illustrated in FIGS. 8 and 9 which covers the through-opening.

The sliding cover plate (40A) is housed within a slot (49B) internal to the body of the head end plate (2) which permits the sliding cover plate to slide in a linear direction between two extreme positions. The slot (49B) permits only this linear motion and no other. In the first extreme position, illustrated in FIG. 9, the through-opening (40B) formed in the sliding cover plate is slid wholly out of register with the correspondingly dimensioned through-opening (40) of the head end plate (2) thereby to close that through-opening. In this position, a notched end recess (40C) formed at an opposite end of the sliding cover plate is positioned in register with the arcuate slot (42) at one slot end thereby to wholly reveal a terminal end of the arcuate slot. This permits the transverse pin (43A) to be slid, by operation of the lock mechanism (41) into the terminal end of the arucate slot and into abutment against the recessed notch (40C) at the end of the sliding cover plate (40A). The lock mechanism is arranged such that, when the obstruction pin is so positioned, the lock mechanism locks the obstruction pin at that position. The locked position of the obstruction pin, within the recessed notch at the end of the sliding cover plate thereby obstructs movement of the cover plate along the slot within which it would otherwise be freely slidable from its extreme position illustrated in FIG. 9.

This means that the sliding cover plate is retained, by the obstruction pin, in the position which covers the through-opening in the head end plate (2) to prevent access to the lifting assembly housed within the inner bollard tube. Only by operation of the locking mechanism (41) to slide the locking pin away from the sliding cover plate, to remove obstruction to its sliding movement, can the sliding cover plate be slid from the first extreme position to a second extreme position illustrated in FIG. 10 in which the through-opening in the sliding cover plate (40B) is brought into alignment and register with the through-opening (40) which passes through the head end cover plate. Concurrently with this positioning, a side edge of the sliding cover plate is brought into a position which obstructs movement of the obstruction pin into the extreme end of the arcuate slot (42) in which the lock mechanism would be otherwise able to adopt the locked state. This prevents the lock mechanism from adopting a locked state when the sliding cover plate is positioned to open the through-opening in the head end plate.

A second arcuate slot (44) is formed within the lower surface of the head end plate and has a radius of curvature coincident with the centre of the through-opening (40). The second arcuate slot (44) is adapted to receive the end of a pin (46) fixed to and projecting upwardly from the surface uppermost in use of the upper abutment plate (20) of the lifting assembly. Similarly, the uppermost surface of the upper abutment plate (20) possesses an array of three further arcuate slots (61, FIGS. 12, 13) each of which is adapted to receive a respective one of the ends of three bolts (46A) which extend downwardly from the underside of the head end plate, each by an equal distance. The further arcuate slots in the upper abutment plate (61, FIGS. 12, 13) each have a radius of curvature centred upon the centre of the through-opening (40) in the head end plate. Furthermore, the further arcuate slots are arranged to narrow along their lengths to an extent sufficient to admit the diameter of the shaft of a respective bolt (46) but not to admit the corresponding head of the bolt. Each of the three bolts (46) is lengthed to permit the head of the respective bolt to pass through a further arcuate slot in the uppermost abutment plate to a reverse side of the slot. By subsequent rotation of the head end plate about the axis of the inner bollard tube, the shafts of respective bolts may be slid into the narrowed portions of the further arcuate slots to concurrently position the heads of those bolts in a position on the reverse side of the slot which prevents the bolt heads passing out of the slots transversely. This prevents the head end plate from being lifted from the upper abutment plate.

Concurrently, with this rotation action, the pin (46) upstanding from the upper abutment plate is received within the second arcuate slot (44) at the underside of the head end plate (2) only when the sliding plates (40A) is in the extreme position which reveals the through-opening (40). Conversely, when the sliding cover plate (40A) is moved into the other extreme position and which closes the through-opening (40A) a portion of the second arcuate slot (44) is obstructed by a side edge (45) of the sliding cover plate to hold the upstanding pin (46) at one extreme end of the second arcuate slot (44) which holds the head end plate in the position which locates the three bolts (46) within the narrowed portions of the three further arcuate slots (61, FIGS. 12, 13) formed within the uppermost surface of the abutment plate thereby to prevent rotation of the head end plate in a direction which would permit it to be to be removed from the lifting assembly.

Thus, the locking mechanism and sliding cover plate of the head end plate (2) serves not only to prevent unauthorised access to the lifting assembly through the through-opening (40), but also serves to prevent removal of the head end plate from the top of the inner bollard tube without appropriate use of the locking mechanism (41).

FIG. 12 shows a perspective view of the lifting assembly unit comprising the lead screw lifting assembly (21, 11, 24 etc) and three gas struts (19) retained between the upper and lower abutment plates (20, 24) of the unit. It is to be noted that the unit may be entirely removed from within the bore of the inner and outer bollard tubes as one when uncoupled from the base plate (4) of the outer bollard tube and the head end of the inner bollard tube.

A through-opening in the upper abutment plate reveals the head end (21) of the lead screw to permit access to the head end for applying rotational forces to operate the lifting mechanism. The slot edges of a slidingly retractable slotted obstruction plate (60) passes against and around an upper shaft portion of the lead screw at one semi-circumferential side of the shaft between the head end of the lead screw and an upper retention nut (62) attached to the threaded outer surface of the lead screw adjacent to its head end. The slot of the obstruction plate is linear and dimensioned to snugly accept the upper shaft portion of the lead screw so as to obstruct access to the upper retention nut, and prevent its removal by unscrewing from the lead screw (towards the head end thereof).

FIG. 13 shows the unit of FIG. 12 in which the obstruction plate has been removed to fully reveal the upper retention nut (62) which may be removed from the lead screw by unscrewing it along the axis of the lead screw toward the head end (21). Removal of the upper retention nut in this way, when the unit had been decoupled from the upper tube, can result in a rapid and dangerous extension of the three gas struts if they are not already safely in the fully extended state. It is noted that the gas struts, unless fully extended, perpetually urge to do so against the upper and lower abutment plates (20, 24) of the unit between which they are held. This urging force is resisted in the unit by the retaining effect of the upper retention nut as follows.

When released from the weight of the outer bollard tube, the urging forces exerted by the gas struts urges to push the upper retention flange plate (20) and the outer box-section guide tube (11) attached to it, away from the lower abutment plate (24) and the lower box-section tube (12) attached to it. This separation force is resisted only by the upper retention nut (62) which is fixed adjacent the head end of the lead screw between that head end and the rotation bearing (16, 17). The slidingly mounted rotation bearing (16, 17) is urged, by the urging force transmitted through the outer box-section guide tube (11) to which it is connected, to bear against the lower end of the upper retention nut in this state. This maintains the connection between the upwardly urged box-section outer guide tube (11) to the downwardly urged inner box-section guide tube (12).

Removal of the upper retention nut with the gas struts in the compressed state would permit the rapid separation of the inner and outer box-section guide tubes and their attachments. This is undesirable. The obstruction plate (60) prevents access to the upper retention nut when the gas struts are in place. The gas struts, by virtue of their force-exerting state when not fully extended, are generally difficult to remove from between the upper and lower abutment plates even when unfastened thereto. This is due to the frictional force generated between at each end of the gas strut with the surface of the abutment plate against which it urges. The transverse frictional force is typically sufficiently high to make lateral sliding of an end of a gas strut across the flange plate surface very difficult. However, when in the fully extended state, the urging force cannot be applied by continued extension of the gas strut and this renders the transverse frictional force low enough to enable the gas struts to be safely removed.

The slot of the obstruction plate is defined by the separation between two parallel flat plate limbs (65) which extend from a flat, co-planar plate body which joins the plate limbs and defines the terminus of the slot shaped to receive the shaft of the lead screw. The obstruction plate expands (64) to a flat, co-planar head portion at an end of the plate body opposite to that from which the limbs extend. The ends of the plate limbs are received within a respective one of two slots (68) formed in the wall of the outer box-section guide tube (11) opposite the a longer slot (69) formed in an opposing wall of the guide tube (11) within which the body of the plate is received concurrently when the head portion of the plate abuts the outer wall of the box-section guide tube adjacent to the longer slot. In this way opposite sides of the obstruction plate are braced within slots in the walls of the guide tube.

The head portion of the obstruction plate extends over, and is abutted by, the head end of one of the three gas struts (19) which urges against the obstruction plate there when in other than the fully extended state. This urging force assists in frictionally restraining the obstruction plate within the slots of the guide tube (11) and in contact with the gas strut (19). A through-opening (63) is formed in the head portion of the obstruction plate in register with the head end of the gas strut for receiving a fixing nut for receiving (at one side of the nut) a bolt (66) at the head end of the gas strut. The received nut (not shown) is dimensioned to concurrently receive (at its other side) a nut from the upper abutment plate (20) thereby to fix the gas strut to the abutment plate.

FIGS. 16A, 16B and 16C show this arrangement in side view and cross-sectional detail. The nut received within the through-opening (63) in the head portion of the obstruction plate is omitted for clarity, as are the two bolts it is adapted to receive.

FIGS. 17A, 17B and 17C show the arrangement of FIGS. 16A, 16B and 16C in which the obstruction plate has been removed. It is to be noted that such removal initially the removal of the obstructing gas strut in register with the through-opening of the obstruction plate. This can only be achieved, practically speaking, when the gas struts are safely in the fully extended state, as described above. The nut received within the through-opening (63) in the head portion of the obstruction plate is omitted for clarity, as are the two bolts it is adapted to receive.

The embodiments described above are intended to provide non-limiting illustrations of examples of the invention and modifications, variants and alternatives thereto such as would be readily apparent to the skilled person are encompassed within the scope of the invention, such as is defined by the claims.

The invention claimed is:

1. A bollard apparatus comprising:

an outer bollard member comprising a bore;

an inner bollard member at least a part of which is located within said bore and is moveable along the bore from a retracted state in which at least some of the inner bollard member is located within the bore to an extended state in which less of the inner bollard member is located within the bore;

at least one urging member arranged to exert an urging force upon the inner bollard member to urge the inner bollard member towards the extended state;

a lifting apparatus coupled to the inner bollard member and operable to exert a lifting force thereupon sufficient to lift the inner bollard to the extended state when also subject to the urging force, in which the lifting apparatus is coupled to the at least one urging member and is arranged to resist the urging force exerted by the at least one urging member to prevent movement of the inner bollard member towards the extended state unless said lifting force is also applied by the lifting apparatus and in which the lifting apparatus includes a coupler via which the at least one urging member is decouplably coupled to the lifting apparatus and via which said urging force is applied to the lifting apparatus to urge separation of the coupler from the lifting apparatus and in which the coupler includes an obstructer positioned to present a removable obstruction to access to the coupler to prevent decoupling of the coupler from the lifting apparatus, wherein removal of the obstructer is obstructed by an at least one urging member.

2. A bollard apparatus according to claim 1 wherein the at least one urging member is arranged to exert said urging force which is insufficient substantially to lift the inner bollard member to the extended state.

3. A bollard apparatus according to claim 1 in which the lifting apparatus includes a body member coupled to the outer bollard member and a limb member which is coupled to the inner bollard member and which is operable to retractably extend from the body member to exert said lifting force when so coupled.

4. A bollard apparatus according to claim 1 in which the inner bollard member includes a bore within which at least a part of the lifting apparatus is located and coupled to the inner bollard member.

5. A bollard apparatus according to claim 1 in which the inner bollard member includes a bore within which at least a part of the at least one urging member is located and coupled to the inner bollard member.

6. A bollard apparatus according to claim 1 in which the at least one urging member is mounted upon the lifting apparatus independently of both the inner bollard member and the outer bollard member thereby to collectively define a retractably extendable unit detachably attached to both the inner bollard member and the outer bollard member concurrently.

7. A bollard apparatus according to claim 1 in which the lifting apparatus is coupled to the at least one urging member and is arranged to resist the urging force exerted by the at least one urging member to prevent movement of the inner bollard member towards the extended state unless said lifting force is also applied by the lifting apparatus.

8. A bollard apparatus according to claim 1 in which the lifting apparatus is coupled to the at least one urging member and is arranged to resist the urging force exerted by the at least one urging member to prevent movement of the inner bollard member towards the extended state unless said lifting force is also applied by the lifting apparatus and in which the lifting apparatus includes a coupler via which the at least one urging member is decouplably coupled to the lifting apparatus and via which said urging force is applied to the lifting apparatus to urge separation of the coupler from the lifting apparatus.

9. A bollard apparatus according to claim 1 in which the lifting apparatus comprises a lead screw coupled to the inner bollard member and a nut coupled to the outer bollard member and arranged to engage the lead screw to translate turning motion of a lead screw into linear motion thereof through the nut.

10. A bollard apparatus according to claim 1 in which the lifting apparatus comprises a lead screw coupled to the inner bollard member and a nut coupled to the outer bollard member and arranged to engage the lead screw to translate turning motion of a lead screw into linear motion thereof through the nut wherein the lead screw is coupled to the inner bollard member and the nut is coupled to the outer bollard member such that said lifting force is generated by action of rotation of the lead screw relative to the nut.

11. A bollard apparatus according to claim 3 in which the lifting apparatus comprises a lead screw coupled to the inner bollard member and a nut coupled to the outer bollard member and arranged to engage the lead screw to translate turning motion of a lead screw into linear motion thereof through the nut and wherein the lead screw is coupled to the inner bollard member and the nut is coupled to the outer bollard member such that said lifting force is generated by action of rotation of the lead screw relative to the nut and wherein the at least one urging member is arranged to exert said urging force which is insufficient substantially to lift the inner bollard member to the extended state, the apparatus including a guide bore of non-circular cross-sectional profile to which the lead screw is rotatingly secured to extend therealong to pass through the nut, and said nut is secured to said body member which extends into the guide bore to slidingly interface with the guide bore when the guide bore is moved relative to the nut by action of said rotation, wherein the body member is shaped to reciprocally match at least a part of the non-circular cross-sectional profile of the guide bore to prevent rotation of the lead screw relative to the nut by action of rotation of the inner bollard member relative to the outer bollard member.

12. A bollard apparatus according to claim 1 in which the lifting apparatus comprises a hydraulic ram adapted to generate said lifting force hydraulically.

13. A bollard apparatus according to claim 1 in which the lifting apparatus comprises a pneumatic ram adapted to generate said lifting force pneumatically.

14. A bollard apparatus according to claim 1 in which the lifting apparatus comprises an electro-mechanical ram adapted to generate said lifting force electro-mechanically.

15. A bollard apparatus according to claim 1 in which the inner bollard member includes a bore within which the lifting apparatus is housed concurrently within the bore of the outer bollard member wherein the inner bollard member includes a through-opening at a terminal end of the inner bollard member permitting external access to the lifting apparatus within the bore thereof, and a cover part moveable from a releasably securable position which covers the through-opening to a position which reveals the through-opening.

16. A bollard apparatus according to claim 1 in which the inner bollard member includes a bore within which the lifting apparatus is housed concurrently within the bore of the outer bollard member wherein the inner bollard member includes a through-opening at a terminal end of the inner bollard member permitting external access to the lifting apparatus within the bore thereof, and a cover part moveable from a releasably securable position which covers the through-opening to a position which reveals the through-opening and including a removable plate part releasably coupled to the terminal end of the inner bollard member via a coupling interface achievable by steps including rotating the removable plate relative to the terminal end of the inner bollard member, wherein the cover part is adapted to obstruct rotation of the removable plate from the coupling interface when in said releasably securable position, and to permit rotation of the removable plate from the coupling interface when in said position which reveals the through-opening.

17. A retractable bollard including the bollard apparatus of claim 1 being retractably extendable by retractably extending the inner bollard member relative to the outer bollard member using said lifting apparatus.

18. A vehicle impact barrier comprising a bollard apparatus according to claim 1.

19. A kit of parts for a bollard apparatus comprising:

an outer bollard member comprising a bore;

an inner bollard member at least a part of which is adapted to be located within said bore to be moveable along the bore from a retracted state in which at least some of the inner bollard member is located within the bore to an extended state in which less of the inner bollard member is located within the bore;

at least one urging member adapted to exert an urging force upon the inner bollard member to urge the inner bollard member towards the extended state;

a lifting apparatus adapted to be coupled to the inner bollard member and operable to exert a lifting force thereupon sufficient to lift the inner bollard to the extended state when also subject to the urging force, in which the lifting apparatus is coupled to the at least one urging member and is arranged to resist the urging force exerted by the at least one urging member to prevent movement of the inner bollard member towards the extended state unless said lifting force is also applied by the lifting apparatus and in which the lifting apparatus includes a coupler via which the at least one urging member is decouplably coupled to the lifting apparatus and via which said urging force is applied to the lifting apparatus to urge separation of the coupler from the lifting apparatus and in which the coupler includes an obstructer positioned to present a removable obstruction to access to the coupler to prevent decoupling of the coupler from the lifting apparatus, wherein removal of the obstructer is obstructed by an at least one urging member.

* * * * *